United States Patent [19]

Reichl

[11] Patent Number: 4,762,528

[45] Date of Patent: Aug. 9, 1988

[54] FLUID FUEL FROM COAL AND METHOD OF MAKING SAME

[76] Inventor: Eric H. Reichl, P.O. Box 472, Princeton, N.J. 08542

[21] Appl. No.: 903,602

[22] Filed: Sep. 5, 1986

[51] Int. Cl.[4] ..... C10L 1/32

[52] U.S. Cl. ..... 44/51; 48/197 R; 423/437; 423/454; 423/459; 423/449

[58] Field of Search ..... 44/51; 48/197 R, 215; 423/459, 437, 454, 449

[56] References Cited

U.S. PATENT DOCUMENTS

| | | | |
|---|---|---|---|
| 1,812,230 | 6/1931 | Aarts | 423/459 |
| 1,815,781 | 7/1931 | Kröner | 423/459 |
| 1,964,744 | 7/1934 | Odell | 423/459 |
| 1,984,380 | 12/1934 | Odell | 423/454 |
| 3,764,547 | 10/1973 | Schlinger et al. | 44/51 |
| 3,846,087 | 11/1974 | Dille et al. | 44/51 |
| 3,861,885 | 1/1975 | Schora | 423/459 |
| 3,996,026 | 12/1976 | Cole et al. | 44/51 |
| 4,045,092 | 8/1977 | Keller | 44/51 |
| 4,069,022 | 1/1978 | Metzger | 44/51 |
| 4,185,083 | 1/1980 | Walker | 423/459 |

FOREIGN PATENT DOCUMENTS

| | | | |
|---|---|---|---|
| 51-045186 | 4/1976 | Japan | 44/51 |
| 57-139187 | 8/1982 | Japan | 44/51 |
| 1056184 | 1/1967 | United Kingdom | 44/51 |

*Primary Examiner*—William R. Dixon, Jr.
*Assistant Examiner*—Margaret B. Medley
*Attorney, Agent, or Firm*—Harry B. Keck

[57] ABSTRACT

Coal is gasified to produce carbon monoxide which is converted to carbon by a reverse Boudouard reaction $$2CO \rightarrow CO_2 + C$$

The carbon dioxide is recycled and reacted with coal to create more carbon monoxide by the Boudouard reaction $$CO_2 + C \rightarrow 2CO$$

The resulting carbon is recovered and mixed with a liquid to form a liquid slurry of particulate carbon which is useful as a liquid fuel. The liquid may be water or hydrocarbonaceous liquids. The process optimizes recovery of carbon from coal in a usable form, substantially free of sulfur, hydrogen, ash and nitrogen.

5 Claims, 1 Drawing Sheet

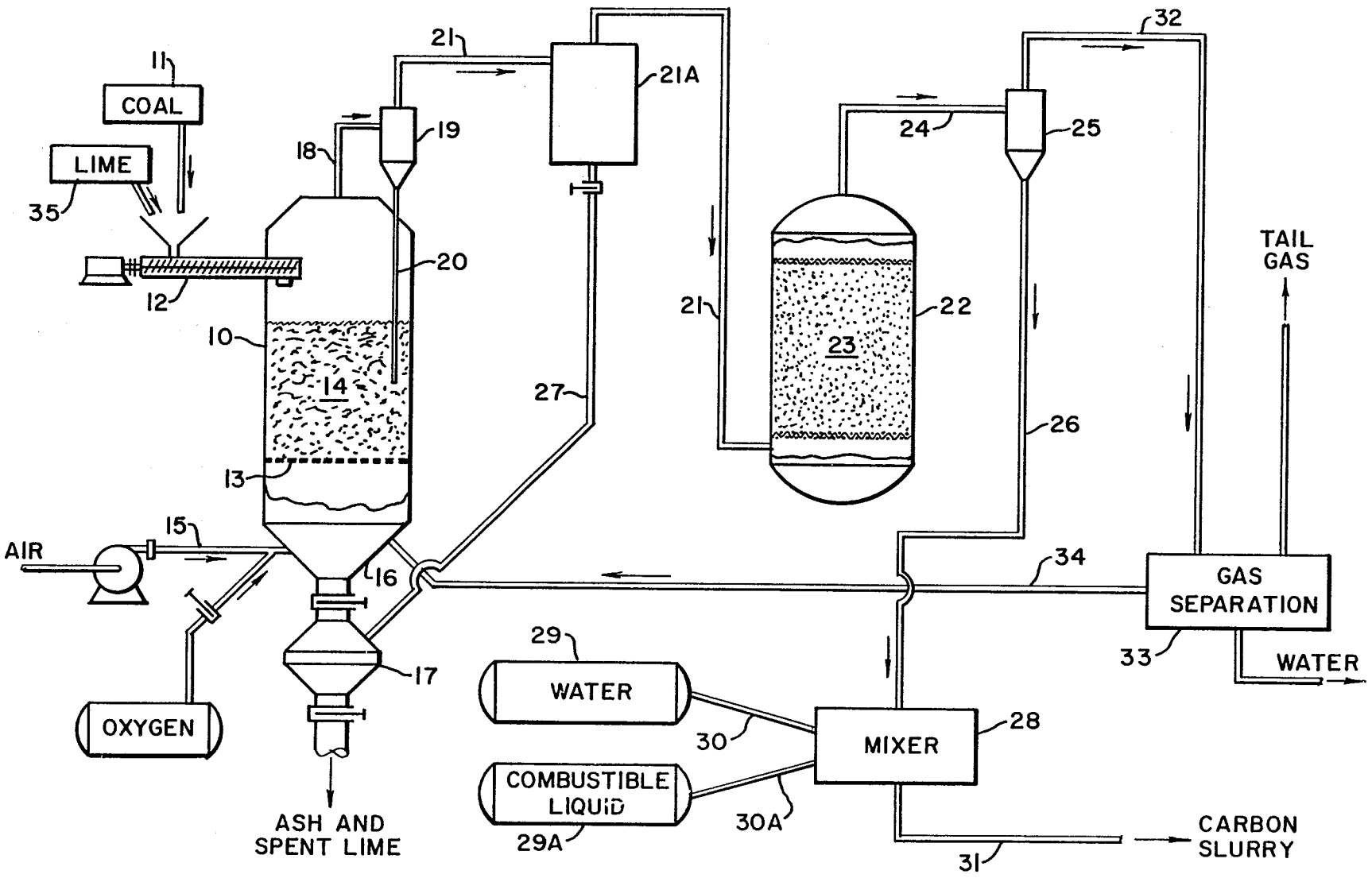
TAIL GAS
GAS SEPARATION
WATER
CARBON SLURRY
32
25
26
34
33
28
31
24
22
23
MIXER
30A
30
21
21A
27
WATER
COMBUSTIBLE LIQUID
29
29A
21
19
20
17
16
14
18
ASH AND SPENT LIME
10
13
11
COAL
12
15
OXYGEN
LIME
35
AIR

FLUID FUEL FROM COAL AND METHOD OF MAKING SAME

BACKGROUND OF THE INVENTION

1. Field of the Invention

The present invention relates to a fluid fuel obtained from coal in the form of a liquid slurry of particulate carbon and relates to a process for preparing such fluid fuel.

2. Description of the Prior Art

Coal is a combustible natural substance containing carbon and hydrocarbons which are low in hydrogen content. The transportation, storage and use of coal as a fuel presents problems because of (a) the solid nature of the product; (b) the non-uniformity of the chemical and physical composition; (c) the omnipresent ash content which must be discarded following combustion of the coal; (d) the presence of sulfur in coal which appears in the coal combustion gases as sulfur oxides which present atmospheric pollution problems.

The technical literature exhaustedly proposes conversion of coal into liquid or gaseous fuels which avoid the recited problems of coal utilization. Overwhelmingly the objective of coal conversion heretofore has been to produce hydrocarbonaceous fuels such as gases (methane, water gas, producer gas and coal distillation gases) or liquid fuels by various combinations of solvent extraction of coal; coal distillation; hydrogenation; reformation (e.g., Fisher-tropsch, et cetera).

Overwhelmingly the coal utilization technology has recognized coal to be a high carbon, low hydrogen content fuel and has attempted to recover the hydrogen-rich ingredients for further upgrading into hydrogen-rich liquid or gaseous fuels and to burn or react the surplus carbon content to provide thermal energy for the remainder of the process and to generate hydrogen-rich gas to offset the hydrogen-deficiency of the coal.

The ODELL patent (U.S. Pat. No. 1,964,744) describes a process for producing carbon black by obtaining carbon monoxide (possibly from coal) and converting the carbon monoxide through the reverse Boudouard reaction:

$$2CO \rightarrow CO_2 + C$$

ODELL recovers carbon black as a high purity specialty product. The ODELL process is understandably profligate in energy consumption, understandably, in view of the relatively low value of energy at the time the ODELL process was proposed (1930). ODELL recognizes the importance of recovering carbon dioxide from the Boudouard reaction and recirculating the carbon dioxide through a carbonaceous fuel bed to create additional carbon monoxide. ODELL further recognizes that elevated pressures promote carbon production in the Boudouard reaction and recognizes that steam can be employed as a moderating gas to regulate the Boudouard reaction exotherm.

As far as can be determined, in more than 50 years since the ODELL patent, there have been no commercial attempts to produce carbon black via the ODELL process.

There have been prior suggestions that coal be converted primarily to carbon and that the resulting high purity carbon be admixed with water to produce an aqueous slurry which functions as a pumpable fuel of essentially zero ash content and essentially zero sulfur content for use in furnaces, internal combustion engines, turbines and the like. Such suggestions have proposed hydrogenating coal to maximize methane production and to convert the methane by thermal decomposition into hydrogen gas which is recycled in the process and high purity carbon for subsequent combination with water to form an aqueous slurry constituting a fluid fuel.

STATEMENT OF THE PRESENT INVENTION

According to the present invention, coal is gasified in a first vessel to produce a first gas stream rich in carbon monoxide and comprising in addition products of combustion (carbon dioxide, steam), products of disproportionation (hydrogen), nitrogen and sulfur compounds. The first gas stream is catalytically treated in a second reaction vessel to convert carbon monoxide by a reverse Boudouard reaction $$2CO \rightarrow CO_2 + C$$

and generate free carbon as a solid product and carbon dioxide as a gaseous product. The gaseous effluent stream from the Boudouard reaction vessel contains unreacted carbon monoxide, carbon dioxide, steam, free hydrogen and impurities. The gaseous effluent stream is separated into a residue gas stream and a carbon dioxide rich stream which is returned to the gasification vessel for added reaction of the coal by the Boudouard reaction:

$$CO_2 + C \rightarrow 2CO$$

Carbon is recovered from the Boudouard reaction vessel effluent and is mixed with liquid to form an essentially zero ash, zero sulfur, zero nitrogen, carbonaceous slurry which is recoverable as a fluid fuel.

The gasification may be carried out in the presence of lime or similar reagents to minimize sulfur contamination in the effluent gas stream. The gasification may be carried out with air as the source of oxygen in which case a substantial quantity of nitrogen gas passes through the reaction vessel and the Boudouard reaction vessel. Alternatively the reaction vessel may receive oxygen or oxygen-enriched air to eliminate or to substantially reduce the amount of nitrogen in the system. The gasification vessel is operated to minimize coal tars and hydrocarbonaceous coal gases in the effluent gas stream. The gasification preferably is carried out at elevated pressure, e.g., 2 to 20 atmospheres.

Accordingly it is an objective of the present invention to produce a fluid fuel from coal comprising a liquid slurry of particulate carbon having essentially zero ash and essentially zero sulfur and zero nitrogen. The fluid fuel is a slurry containing 55 to 75 weight percent particulate carbon in water, alcohol or hydrocarbon liquid.

It is a further object of this invention to maximize the recovery of pure carbon from coal and to maximize the oxidation of hydrogen which is contained in the coal.

These and other objects of this invention will become apparent by reference to the following detailed description and to the accompanying drawings.

DESCRIPTION OF THE DRAWING

FIG. 1 is a schematic flow diagram illustrating the preferred embodiment of the present invention.

DESCRIPTION OF THE PREFERRED EMBODIMENT

The designation "coal" includes a variety of mineral products ranging from anthracite coal through bituminous coal, sub-bituminous coal and lignite. The fixed carbon content of mineral-free coal ranges from about 94 percent for anthracite to about 70 percent or less for dry lignite. The hydrogen content ranges from about 2.7 percent for anthracite to about 5 percent or more for dry lignite. All of these mineral products characterized as "coal" are useful in the practice of the present invention. The coal preferably will be reduced in size to minus-¼-inch and preferably will be gasified in a fluidized bed reaction vessel 10. The reaction vessel 10 receives coal from a source 11 through a solid feeding device 12. The reaction vessel 10 has a generally horizontal porous grating 13 which supports a fluidized bed 14. Air or oxygen-enriched air is introduced through a conduit 15 beneath the porous grid 13. Upwardly rising gas maintains the coal particles in the bed 14 in a fluidized suspension. Gasification of the coal occurs at a temperature from 800° to 1100° C. and at atmospheric or superatmospheric pressure from 2 to 30 atmospheres. Ash and spent lime from the reaction falls through the porous plate 13 into a conical receptacle 16 and is recovered through a lock hopper 17 for disposal. Alternate constructions for the bottom of the reaction vessel 10 are commercially available from established suppliers. Gases are recovered from the top of the reaction vessel 10 through a conduit 18 and are separated from entrained solids in a cyclone 19 from which the entrained solids are returned to the fluidized bed 14 through a down pipe 20. Overhead gases in a conduit 21 may be further treated in a treatment zone 21A to remove remaining particulates and sulfur compounds. The solids are withdrawn through a conduit 27. The clean, hot gases are delivered to a catalytic vessel 22 containing appropriate catalyst for the reverse-Boudouard reaction. Such catalysts are known in the art to include nickel, iron, iron oxide, iron-containing manganese, copper, zinc, zinc oxides and other metal or metal oxide which may readily be reduced. The active catalyst ingredient can be deposited on an appropriate catalyst support, such as alumina, silica, silica alumina and other refractory materials.

A reaction bed 23 within the reaction vessel 22 is maintained at an appropriate temperature from 450° to 700° C. and elevated pressure to achieve effective conversion of carbon monoxide to carbon dioxide and free carbon by the reverse Boudouard reaction:

$$2CO \rightarrow CO_2 + C$$

The reaction is strongly exothermic; therefore means to control the temperature at the desired level must be provided.

Free carbon from the reverse-Boudouard reaction will be formed principally within the bed 23 and carried overhead as entrained solid particles through a conduit 24 which communicates with a cyclone 25 for separating the particulate carbon particles and recovering them through a down pipe 26 into a mixing vessel 28. Liquid from a source 29 is delivered through a conduit 30 to the mixture 28 and a liquid slurry of finely divided essentially zero ash, essentially zero sulfur carbon and zero nitrogen is recovered as a product through a conduit 31 in the form of a fluid fuel. Preferably the product liquid fuel is a slurry containing from 55 to 75 weight percent particulate carbon. Water is a preferred slurry liquid.

In alternative embodiments, the particulate carbon may be slurried with combustible liquids such as hydrocarbonaceous liquids (gasoline, LPG, kerosene, fuel oils, heavy fuel oils, tars, vegetable oils, alcohols and the like) from an alternative source 29A.

The overhead gases from the cyclone 25 are delivered through a conduit 32 to a gas separation zone 33 which selectively recovers carbon dioxide which is delivered through a conduit 34 for recycle into the reaction vessel 10. The carbon dioxide within the vessel 10 reacts with the heated carbon in the Boudouard reaction $$C + CO_2 \rightarrow 2CO$$

to yield more carbon monoxide for the process.

Within the gas separation zone 33, the gases from the conduit 32 are selectively scrubbed for recovery of carbon dioxide using known processes yielding a final tail gas of nitrogen, unreacted carbon monoxide, hydrogen and methane. As an alternative, the tail gas may first be burned to achieve total oxidation of hydrogen and carbon monoxide to steam and the heat recovered for external use, prior to recovery of carbon dioxide for recycle.

Thus the objective of this invention is achieved, i.e., to optimize the conversion of the carbon in the coal into particulate carbon particles contained in a slurry and recovery of residual energy for other uses.

In an effort to minimize the presence of sulfur-containing gases in the system, it may be desirable to introduce into the gasifier alkaline earth oxide or carbonate such as lime, limestone, dolomite and the like from a container 35 into the solids feeder 12 along with the incoming coal. The lime or the like may be introduced into the reaction vessel 10 separately from the coal if desired. The amount of lime or the like will depend upon the content and nature of the sulfur in the coal.

Sulfur from the original coal will appear in the ash product from the reaction vessel 10 in the form of solid lime salts.

I claim:

1. A method for generating from coal a liquid fuel in the form of a combustible liquid carbon slurry comprising:

a. reacting substantially the entire said coal with oxygen and carbon dioxide in a gas generation chamber to produce products consisting essentially of ash and carbon monoxide entrained in a gas stream with reacted gases and other gases;

b. passing said gas stream into a reaction chamber containing catalyst for the reverse Boudouard reaction to convert the carbon monoxide into carbon dioxide and free carbon and recovering the free carbon from the reaction chamber;

c. separating the gases in said reaction chamber into carbon dioxide and residue gases; and d. returning at least a portion of the carbon dioxide rich gas stream to the said gas generation chamber for reaction with coal;

e. recovering the said residue gas stream.

2. The method of claim 1 wherein the said liquid is water and the resulting product is an aqueous carbon slurry.

3. The method of claim 1 wherein the said liquid is a combustible liquid and the resulting product is a slurry of particular carbon in combustible liquid.

4. The method of claim 1 wherein the resulting slurry contains 55 to 75 weight percent particulate carbon.

5. The method of claim 1 wherein the said gas generation chamber is a fluidized bed reaction vessel.

* * * * *